United States Patent [19]

Jones

[11] 4,182,081

[45] Jan. 8, 1980

[54] COMBINED PARTING BEAD EXTENDER AND WEATHER STRIP COVER FOR WINDOW INSTALLATIONS

[75] Inventor: Barry M. Jones, Berwyn, Pa.

[73] Assignee: QC Glide Co., Sharon Hill, Pa.

[21] Appl. No.: 905,281

[22] Filed: May 11, 1978

[51] Int. Cl.[2] ..... E05D 15/18

[52] U.S. Cl. ..... 49/434; 49/454

[58] Field of Search ..... 49/407, 423, 434, 435, 49/454

[56] References Cited

U.S. PATENT DOCUMENTS

| | | | |
|---|---|---|---|
| 2,273,279 | 2/1942 | MacKlanburg | 49/434 |
| 3,325,945 | 6/1967 | Beasley, Jr. et al. | 49/434 |

*Primary Examiner*—Kenneth Downey

*Attorney, Agent, or Firm*—Scrivener, Parker, Scrivener & Clarke

[57] ABSTRACT

An extender for a combined double hung, double sash guide and weather strip unit is disclosed. The extender is slidably received in the open upper end of the parting bead of the weather strip unit and carries at its upper end prongs. When the extender is driven upwardly, as by raising the window sashes, the extender closes the air gap between the upper edge of the weather strip unit and the head jamb and at the same time the prongs are driven into the head jamb so that the extender also serves to attach the weather strip unit into the window frame thus eliminating the need for top staples or nails.

6 Claims, 4 Drawing Figures

COMBINED PARTING BEAD EXTENDER AND WEATHER STRIP COVER FOR WINDOW INSTALLATIONS

This invention relates to a double hung, double sash window installation and more particularly to unitary combined sash guide and weather strip units for use with such installations.

Unitary combined sash guides and weather-strip units for double hung window installations are well known. Such units comprise a pair of longitudinally extending, side-by-side channel shaped sash guides separated by a sash parting bead, the entire unit being constructed of bent sheet material formed by a metal roll forming operation. In positioning the weather-strip units and sashes in a window frame, the guides are assembled over the side of the sashes in their lowered position and the entire assembly is tilted into the frame; that is to say, the lower end of the assembly is first positioned in its proper location within the frame and is then rocked about its lower end to an upright position in the frame, whereupon staples or nails are driven into the side jamb through flats along the longitudinal outer edge of the end walls of the sash guide channels. In order that the weather strip-members will clear the window frame head jamb when the assembly is rocked to its upright position in the frame, each weather-strip member must be slightly shorter than the side jamb with the result that when the assembly is finally located in its upright position in the frame, a gap naturally exists between the head jamb and the upper end of the weather-strip unit. This gap provides an air leakage path between the interior of the house and the outside and it is one of the objects of the invention to provide means for closing that gap after the assembly has been installed in its proper position within the window frame.

It is another object of the invention to provide means which not only closes the aforementioned gap against air leakage, but also serves as a connector for attaching a weather-strip unit in its position of use within the frame thereby eliminating the need for top stapling or nailing the unit into the frame.

The foregoing and other objects of the invention are accomplished by the provision of a body member of bent sheet material which is adapted to be slidably received within the open upper end of a parting bead of a weather strip unit. The body member carries means, such as outwardly projecting wings, engageable exteriorily of the parting bead for sliding the body member upwardly relative to the parting bead to close the aforesaid gap while simultaneously driving prong means, which may be carried at the ends of the wings, into the head jamb so that the body member then serves as a connector for the weather-strip unit.

The invention will now be described in detail in conjunction with the accompanying drawings wherein.

Figure 1:
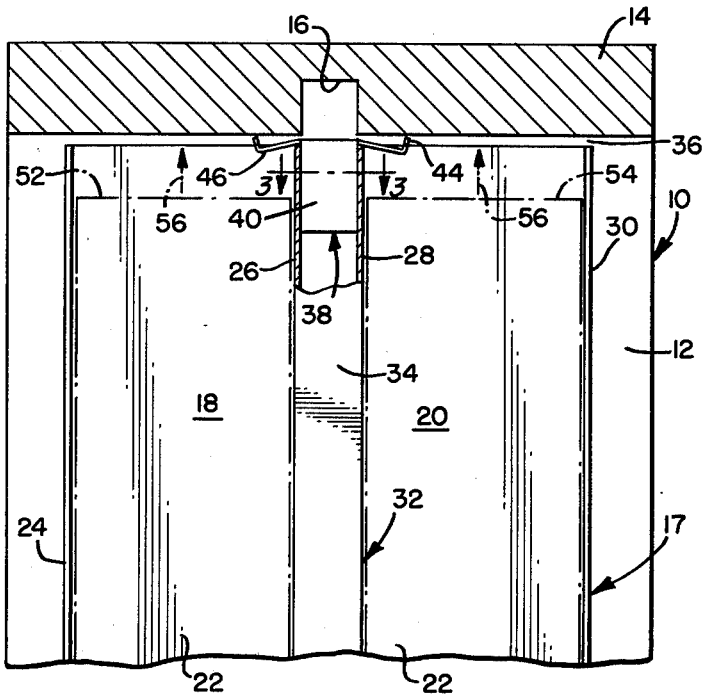
FIG. 1 is a vertical cross-sectional view of the upper end of a window frame with a sash guide and weather-strip unit located therein, and showing the combined parting bead extender and weather-strip connector in its initial condition prior to its being driven upwardly into engagement with the head jamb of a window frame.

Referring now to the drawings, the numeral 10 designates a conventional window frame having side jambs 12 and a head jamb 14, the latter having therein the usual parting bead groove way 16 in which a jamb parting bead, usually of wood, is located. Received within the window frame is a weather-strip unit 17 of known construction having a pair of side-by-side, longitudinally extending channel-shaped sash guides, 18, 20, each defined by an end wall 22 and a pair of spaced side walls 24, 26 and 28, 30, respectively. The sash guide channels are centrally joined together by an integral parting bead 32 defined by a longitudinally extending, open ended, U-shaped channel having a laterally extending end wall 34 joining together in spaced relationship coextensive side walls, each of which also defines one wall 26 or 28 of a respective sash guide channel 18, 20.

As can be seen, when the weather-strip unit is installed in its position of use within the window frame, the unit abuts the side jamb 12 of the window frame with the upper edge of the unit being spaced below the head jamb 14 to define a gap 36 resulting from the need for the weather-strip unit to have sufficient clearance below the head jamb to permit the assembled strips and sashes to be rocked into the window frame as above described without interference between the upper edges of the strip and the head jamb. The gap 36, one on each side of the window, defines a path for air leakage between the interior of a house and the outside.

The present invention provides means for closing off the gap 36 by use of a parting strip extender, and also eliminates the need for top stapling or nailing the weather-strip in place by arranging the parting strip extender so that it serves, in addition, as a weather strip connector. The combined extender and connector is designated generally by the numeral 38 and comprises a U-shaped body of bent sheet material having an end wall 40 and side walls 42 complementary with the internal shape and dimension of the parting bead 32. The body member is adapted to be slidably received within the upper open end of the parting bead 32 and carries upon its upper side prong means 44 located preferably at the ends of integral, out-turned wings 46 extending exteriorily of the parting bead with a length sufficient to ensure that the prongs 42 are clear of the head jamb parting bead grooveway 16. The wings are preferably initially inclined downwardly from the upper side edges of the body member to enable the mounting of the weather-strip in its position of use without the prongs interfering with the head jamb.

Figure 3:
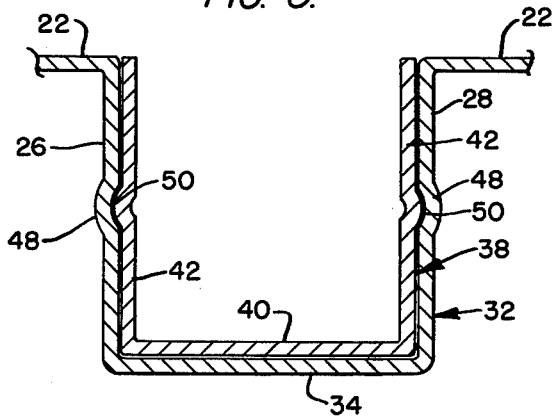
FIG. 3 is an enlarged horizontal cross-sectional view taken substantially on the line 3—3 of FIG. 1.
Figure 4:
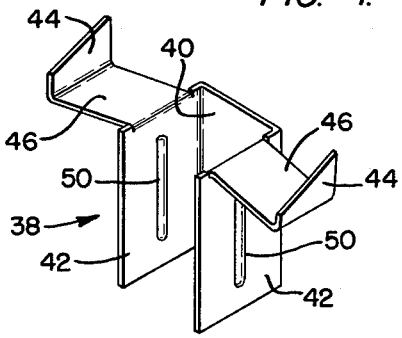
FIG. 4 is a perspective view of the combined parting strip extender and sash guide connector of the present invention.

Desirably the body member, when installed in the parting bead, is keyed against movement away from the end wall 34 of the parting bead. Such keying may be provided in a variety of ways but preferably by way of a groove 48 formed, as by embossment, adjacent the upper end of one or both of the parting bead side walls 26, 28 and a ridge 50 also formed by embossment, on one or both side walls 42 of the body member 38 and slidably engageable with grooves 48 as can be clearly seen in FIG. 3.

Figure 2:
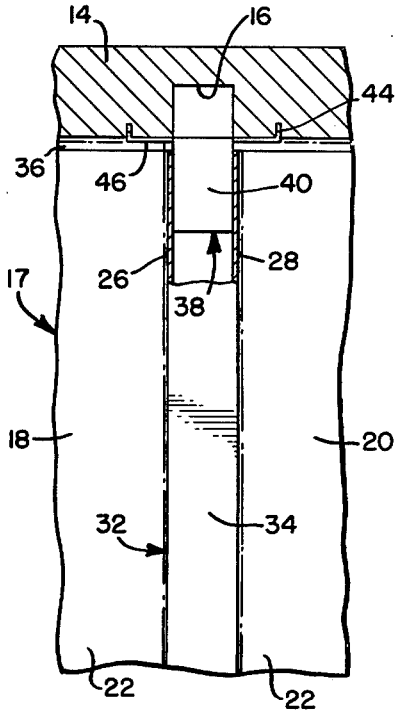
FIG. 2 is a view similar to FIG. 1, but partially broken away, showing the parting bead extender and weather-strip connector after it has been driven into its position of use.

In use, the combined parting bead extender and weather-strip connector is inserted into the open upper end of the parting bead of each weather strip and pushed down as far as the extender can go. The strips are then assembled over the sides of the sashes in their lowered position and the lower edges of the entire assembly is inserted from the inside into the window frame. Thereafter, the assembly is rocked into its upright position until the weather-strip parting bead is in substantial registry with the head jamb grooveway 16 as shown in FIG. 1. Thereafter, the prong means 42 are driven into the head jamb 14, as seen in FIG. 2, by the application of force to the wings 46. Such force not only raises the connector relative to the parting bead to close off the gap 36 but it also straightens the wings 46 as shown in FIG. 2 to a horizontal position as the prong means 44 are driven into the head jamb 14. Force may be applied to the wings by an instrument, such as a hammer, or if desired such force may be provided by merely raising the respective sashes with sufficient momentum to drive the prong means into the wood of the head jamb.

In FIG. 1 phantom lines depict sashes 52, 54 in the process of being moved in the direction of the arrows 56 towards the extended wings, and, in FIG. 2, the sashes 52, 54 are shown in their fully raised position after having driven the prong means into the head jamb.

Desirably the wings are inclined downwardly in order to permit rocking installation of the sash and weather-strip assembly as above described. If the nature of the head jamb or the resiliency of the wings is such that inclined wings are not practical, the wings may be arranged initially substantially horizontally and, if necessary, the upper edge of the weather-strip member can be lowered sufficiently to permit the assembly to be rocked into place without interference by the prongs with the head jamb. Though this would naturally result in a somewhat wider gap 36, this would not be a disadvantage since the parting bead extender can readily close the gap over a substantial range of gap widths.

The sash guide and weather-strip is provided with sash balance springs and spring housings as well known in the art, but these items are not shown in the drawings since they are not concerned with the present invention.

It will be apparent that the invention is susceptible of a variety of changes and modifications without, however, departing from the scope and spirit of the appended claims.

What is claimed is:

1. A combined parting bead extender and weather-strip connector for use with a unitary, double hung, double sash window guide and weather-strip of the type having a pair of side-by-side longitudinally extending, channel shaped sash guides centrally joined together by an integral parting bead defined by a longitudinally extending open ended, U-shaped channel having a laterally extending end wall joining together in spaced relation a pair of co-extensive side walls each of which also defines one wall of a respective sash guide channel, said weather-strip in its position of use being adapted to abut the side jamb of a window frame with the upper end of said weather-strip being spaced below the head jamb of said frame thereby defining a gap between said head jamb and the upper end of said weather-strip; said parting bead extender and weather-strip connector comprising a U-shaped body member having an end wall and side walls complementary with the internal shape and dimensions of said parting bead and being adapted to be slidably received within the upper open end of said parting bead with the end wall of said extender being adjacent the end wall of said parting bead, when said weather-strip and extender are in their position of use, upwardly extending prong means integrally joined with the upper edge of said body member, and means carried by said body member and engageable exteriorly of said parting bead for moving said body member upwardly relative to said parting bead to close the gap between the upper end of said weather-strip and said head jamb while simultaneously driving said prong means into said head jamb to connect said weather-strip in its position of use in said window frame.

2. A combined parting bead extender and weather-strip connector as in claim 1 including out-turned wings integral with the upper edges of the side walls of said body member, the extreme outer ends of said wings being up-turned and defining said prong means, said wings defining the means engageable exteriorily of said parting bead.

3. The combined parting bead extender and weather-strip connector of claim 2 wherein said wings extend into the path of movement of the respective window sashes for engagement thereby and subsequent driving of said prong means into said head jamb.

4. The combined parting bead extender and weather-strip connector of claim 2 wherein said wings are initially inclined downwardly from said side edges in order to locate said prong means in an initial position enabling the mounting of said weather-strip in its position of use in a window frame without interference of said prong means with said head jamb.

5. The combined parting bead extender and weather-strip connector as in claim 1 including means for keying said body member in the open end of said parting bead against movement relative to said parting bead except movement parallel to the longitudinal axis thereof.

6. The combined parting bead extender and weather-strip connector as in claim 5 wherein said keying means comprises a groove in the side wall in one of said parting bead and body member, and a ridge in the other of said parting bead and body member slideably engageable with said groove, said ridge and groove being parallel to the longitudinal axis of said parting bead whereby when said ridge is engaged with said groove said body member is keyed against movement in a direction away from the end wall of said parting bead.

* * * * *